US005734308A

United States Patent [19]

Dittmann et al.

[11] Patent Number: 5,734,308

[45] Date of Patent: Mar. 31, 1998

[54] ELECTROMAGNETIC MONOSTABLE SMALL RELAY

[75] Inventors: Michael Dittmann; Jens Heinrich, both of Berlin, Germany

[73] Assignee: Siemens Aktiengesellschaft, Munich, Germany

[21] Appl. No.: 769,850

[22] Filed: Dec. 19, 1996

[30] Foreign Application Priority Data

Dec. 21, 1995 [DE] Germany ..... 195 48 057.0

[51] Int. Cl.[6] ..... H01H 51/08

[52] U.S. Cl. ..... 335/78; 335/128; 335/156; 335/276

[58] Field of Search ..... 335/78–86, 187, 335/192, 275, 276, 106, 127, 128, 156

[56] References Cited

U.S. PATENT DOCUMENTS 3,317,871 5/1967 Adams ..... 335/230
4,949,058 8/1990 Nishikawa et al. ..... 335/128

FOREIGN PATENT DOCUMENTS

WO 94/22156 9/1994 WIPO ..... H01H 51/22

*Primary Examiner*—Michael L. Gellner
*Assistant Examiner*—Raymond Barrera
*Attorney, Agent, or Firm*—Hill, Steadman & Simpson

[57] ABSTRACT

Electromagnetic, monostable, small relay has a rocker armature arranged between a base plate and a coil, the armature being mounted with its middle segment at the end of an L-shaped yoke, and forming a working air gap with a second yoke. Contact springs are connected with the armature, which work together with fixed contacts anchored in the base. A resetting spring is connected with the armature and prestresses the armature into a rest position on the first yoke. For stabilization of the construction, and for separation between a contact chamber and a coil chamber, a base body is provided with an H-shaped cross-section, which overlaps the base plate in an interleaving manner, and which forms supports for the terminal pins of the base plate on both sides of the armature. In this way, a monostable relay is created, which can have any of conventional soldering pin terminals, SMT terminals, or press-fit terminals.

12 Claims, 3 Drawing Sheets

ELECTROMAGNETIC MONOSTABLE SMALL RELAY

BACKGROUND OF THE INVENTION

1. Field of the Invention

The present invention is directed to an electromagnetic relay, and in particular to an electromagnetic relay which is monostable and which has a small, compact size.

2. Description of the Prior Art

An electromagnetic relay is known form PCT Application WO 94/22156 having a base plate made of insulating material, whose bottom side defines a basic plane and in which supports are anchored for fixed contacts, as well as contact terminal pins. A rocker armature is arranged over the base plate, centrically mounted on both sides with an axis of rotation parallel to the basic plane. A coil is arranged over the armature, whose axis is parallel to the basic plane and perpendicular to the axis of rotation of the armature. A core is arranged axially in the coil, with yokes at both ends directed downwardly perpendicular to the basic plane, whose ends move together with the armature. A contact spring arrangement is connected fixedly with the armature via a sheath of insulating material, which moves together with the fixed contacts of the base plate corresponding to the armature movement.

This known relay, as in similar systems with rocker armatures, is a polarized relay, which in principle has a bistable switching characteristic due to the symmetrical construction of the magnet system with a permanent magnet. Using additional measures such as non-symmetrical alignment, adjustment or balancing of the permanent magnet, non-symmetrical arrangement of separating plates, and non-symmetrical use of resetting spring forces, it is also possible to produce a monostable switching behavior. This is relatively expensive, however, since the permanent magnet itself is already expensive, and the aforementioned additional measures require additional material and manufacturing outlay.

Systems using a rocker armature are also known in which a monostable switching behavior is predetermined by means of non-symmetrical arrangement of a permanent magnet; for example, U.S. Pat. No. 3,317,871 shows a non-symmetrical system of this sort. In one embodiment, the rocker armature is mounted on a yoke leg bent in an L-shape, while the permanent magnet lies between a second yoke leg and an additional non-symmetrically arranged pole shoe. In this case as well, a permanent magnet is required for the monostable system.

SUMMARY OF THE INVENTION

An object of the present invention is to provide a monostable relay with a rocker armature system, which has a structure which is as simple and economical as possible, but which is in many respects the same as in a bistable, polarized system, so that components and manufacturing steps for a bistable system can also be employed for the monostable relay, but at the same time cost advantages can be realized by avoiding the use of a permanent magnet.

Moreover, the relay should be fashioned in such a way that the insulation between the contacts and the coil is improved, while maintaining the overall construction as stable as possible, so that the desired characteristic values of the relay are set in a simple way and are reliably maintained during handling or operation of the relay. In particular, a basic structure is to be provided, which, solely through the incorporation of various connection elements, is suited for soldering pin connection as well as for SMT connection and for press-fit connection.

The objects are achieved in a relay of the generally type initially described wherein the first of two yokes has a support leg bent into an L shape, which extends parallel to the coil axis and forms a bearing point for the armature underneath the center of the coil, while the second yoke forms the only working air gap with the armature, and wherein a resetting spring prestresses the armature into a rest position on the first yoke.

By means of the inventive construction, a monostable system is created in which the rocker armature, as well as most of the other parts, are fashioned as in a bistable system, but a non-symmetry of the magnetic circuit is nonetheless produced by means of the bent extension of the first yoke. In this case, a permanent magnet is not required; in its place, a resetting spring, which is very economical in comparison with a permanent magnet, is introduced. The spring can be connected with the armature by the riveted pins or by means of resistance welding, and can be supported on corresponding support surfaces of the base, e.g. with T-shaped integrally formed cross-legs.

In order to achieve a high mechanical stability of the overall construction, in an embodiment of the inventive relay a base body made of insulating material forms a dividing wall (with through-holes for the yokes), parallel to the basic plane, between the armature and the coil, and the base body is interleaved with the base plate by means of side walls, and forms an at least partly closed switching chamber with this base plate, and the base body has a shoulder on both sides of the armature, under which the contact terminal pins are arranged in a row. This shoulder is suited as a support area for these terminal pins if needed. In another embodiment, the base body has an essentially H-shaped cross-section, and the coil is arranged in an upwardly open tub-shaped coil chamber. The coil preferably can be embedded in sealing compound, which not only ensures a seal but also improves dissipation of heat away from the coil.

The contact spring arrangement preferably includes two contact springs arranged in one plane, each contact spring having a flexible terminal segment extending laterally in the mounting region of the armature. This segment (of each contact spring) is connected with a terminal pin anchored in the base and at the same time serves as a bearing strip for the armature.

For the formation of the terminal elements, conductor paths of a prestamped circuit board can be embedded in the base plate in one plane in a known manner, so as to respectively form supports for the fixed contacts, terminal segments for the contact springs (bent upwardly if necessary), and terminal pins extending vertically downwardly.

The above-described base element construction is particularly effective, however, if terminal pins are used that extend vertically upwardly from the base plate to the respective support region of the base body. In order to avoid redundancy during manufacture, the terminal pins respectively protrude into grooves of the base body and are fixed therein by means of a hardenable sealing compound. In this way it is possible that, after the assembly of the armature with a precise setting of the contact spacings, the magnet system connected with the base body can be pushed onto the base plate until the armature lies exactly on the bearing leg of the first yoke, or has achieved the predetermined air gap relative to the second yoke. By pouring in adhesive or sealing (potting) compound, the base body can then be connected so as to form a seal with the base, with the terminal pins embedded in the aforementioned grooves in a preceding or simultaneous work step. In this way, a tight and stable switching chamber arises that is insulated against the coil. In comparison with relays of similar construction, this switching chamber also has a very small air volume, since the coil chamber is not included therein. This is particularly advantageous if the switching chamber will be subjected to the influence of high heat, such as for example in the soldering strips, in particular reflow soldering of SMT terminals.

The base body thus forms side walls closed at least around the contact chamber, so that a housing cover (as would otherwise be required) can be omitted. An embodiment is thereby particularly advantageous in which the base body has an H-shaped cross-section, and thus also receives the coil in an upwardly open, tub-shaped coil chamber. This coil chamber is usefully filled completely or partially with potting compound, so that the rigidity of the construction is further increased. This is particularly advantageous if the relay is provided with press-fit terminal pins that are anchored in the base body in the manner mentioned above. In this case, a press-fitting tool can press directly on the embedded coil chamber, causing the press-fit forces to be transmitted to the terminal pins via the base body, and there is no danger of an adverse effect on the settings in the relay. A cover can be attached on the upper side of the coil chamber as needed. This can be a metallic plate or can be a metallic outer layer, in particular in order to function as a heat shield in surface mounting (SMT).

DESCRIPTION OF THE PREFERRED EMBODIMENTS

Figure 1:
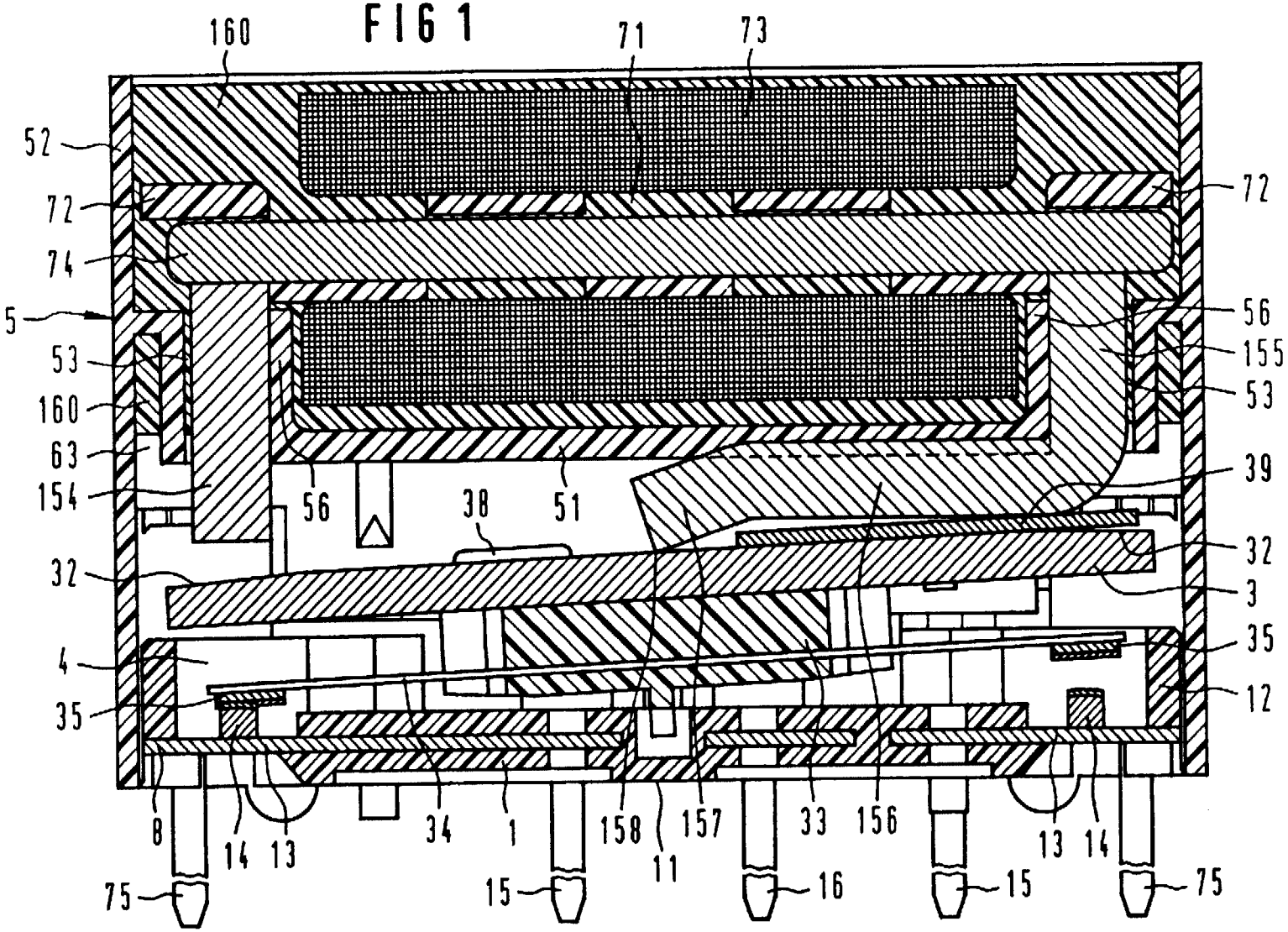
FIG. 1 shows an inventively constructed relay in a longitudinal section through the coil axis.
Figure 2:
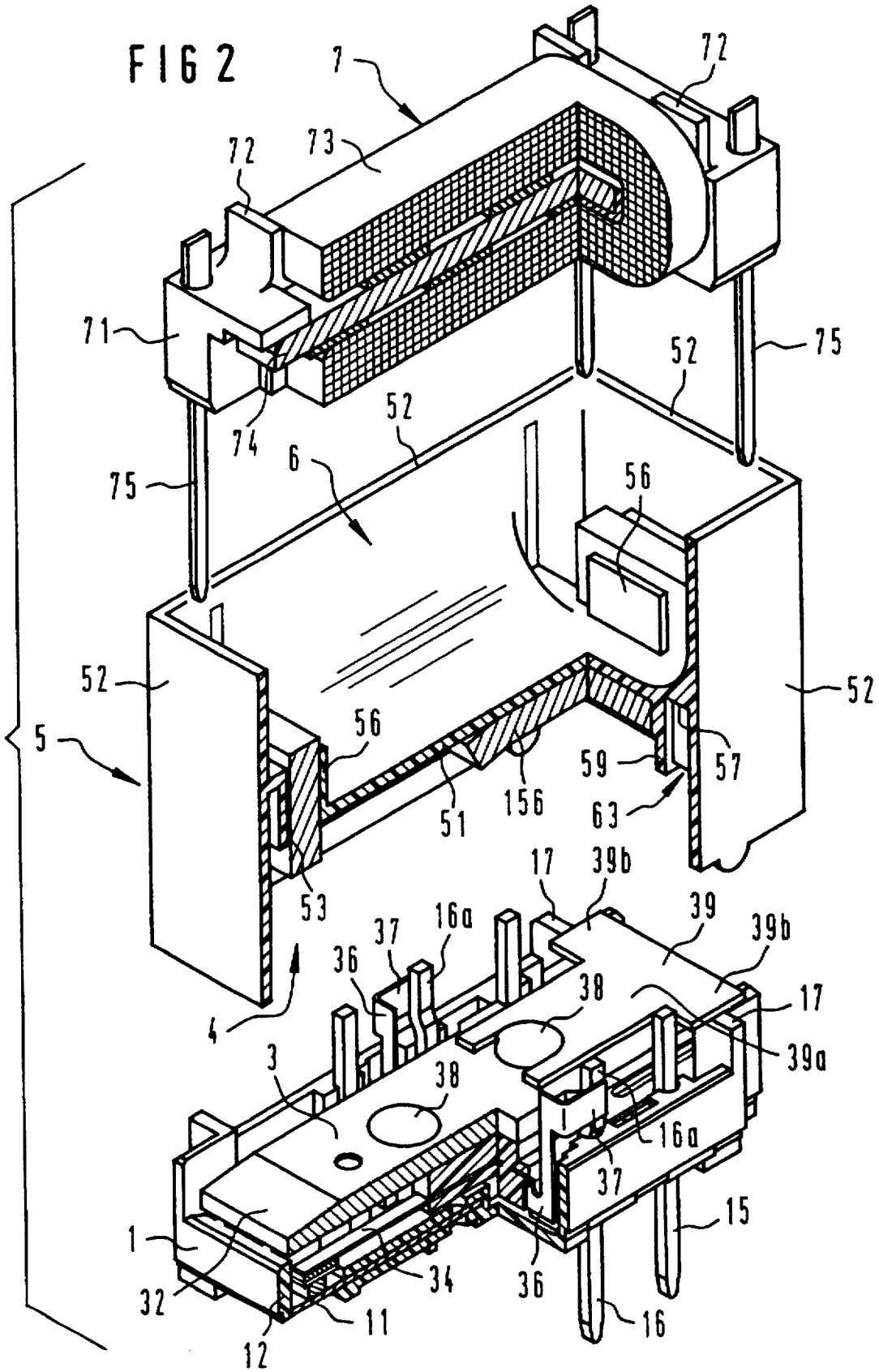
FIG. 2 shows the main modules of the relay of FIG. 1 before assembly, in a partly sectional perspective view.
Figure 3:
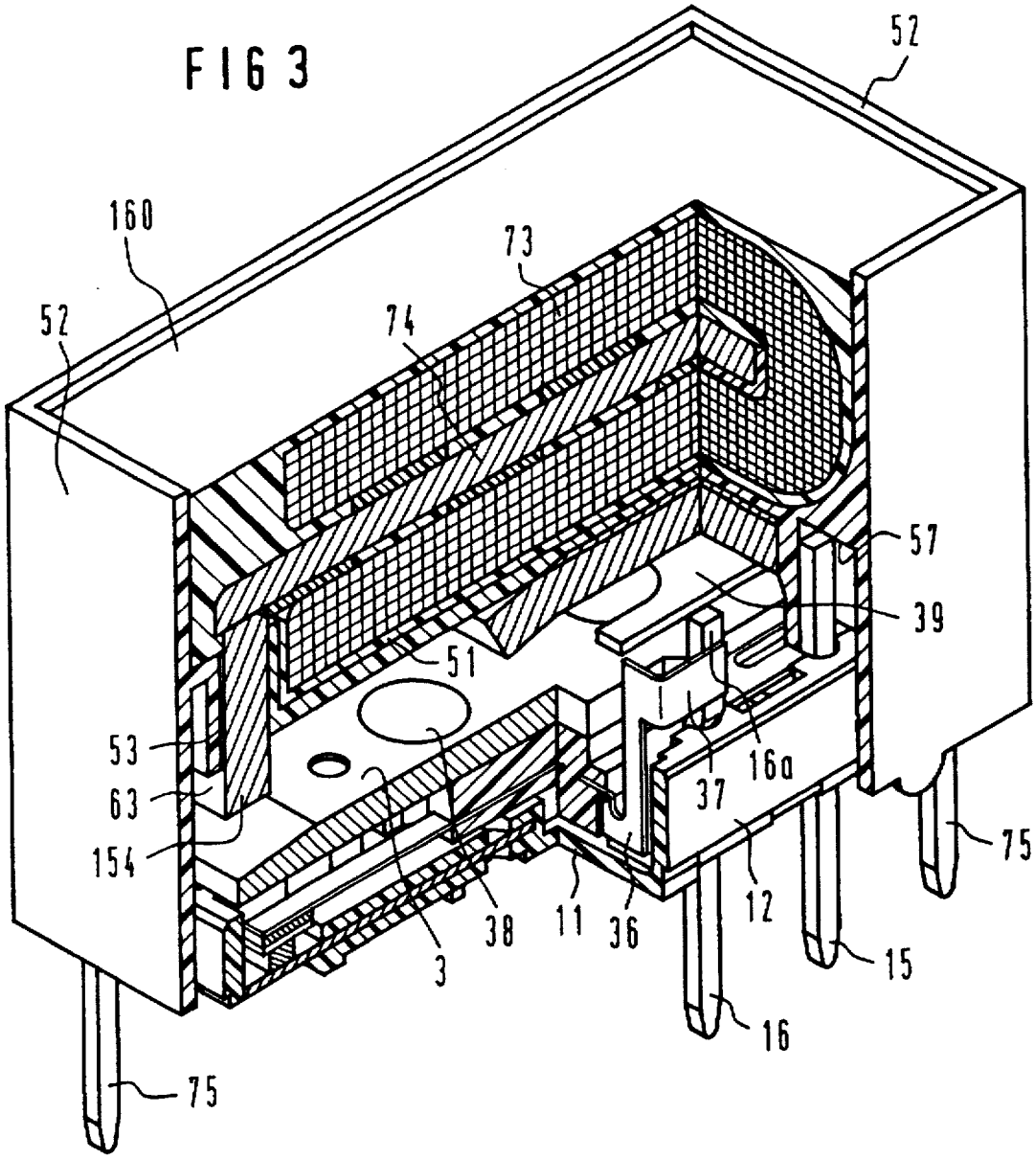
FIG. 3 shows the relay of FIG. 2 in the assembled state, partly sectioned.

The relay shown in FIGS. 1 to 3 is formed essentially of a base plate 1 with an armature 3, arranged rotatably over the base plate 1, and a coil 7. A base body 5 receives the base plate 1 from below, and forms with it a closed contact chamber 4. Moreover, the base body 5 forms an upwardly open coil chamber 6, in which the coil 7 is inserted.

The base plate 1 has a flat bottom 11 that defines the basic plane of the relay, as well as upright circumferential sides 12. Contact supports 13, freely stamped from a metal plate 8, with free-lying fixed contacts 14, are embedded in the insulating material of the base plate 1, parallel to the basic plane. Moreover, terminal pins 15 for the fixed contacts 14, as well as contact spring terminal pins 16, are anchored in the base. These terminal pins 15 can be formed from the metal plate 8 in one piece with the contact supports 13 and bent away, or, as in the example shown, can be inserted into the base plate 1 as pre-manufactured pins with a rectangular or round cross-section and connected with the contact supports 13.

The armature 3 is formed of an essentially elongated ferromagnetic plate, having ends which can be slightly beveled so as to form pole faces 32. A movable contact arrangement with a sheath 33 of insulating material is arranged underneath the armature 3, in which arrangement two elongated contact springs 34 are arranged next to one another in one plane, such that their ends respectively lie free underneath the ends of the armature 3. Movable contacts 35 are respectively mounted at the opposite ends of each spring 34. The contacts 35 work together with the fixed contacts 14 that lie thereunder. Each contact spring 34 has a mounting strip 36 that protrudes laterally from the sheath 33 toward the side area, and which has an arc shape in the region of the armature mounting. Each mounting strip 36 is bent into a vertical position, and is welded to a bearing support 16*a* with a corresponding fastening segment 37 or is conductively connected to this support 16*a* in some other way. The two bearing supports 16*a* are respectively part of the associated contact spring terminal pin 16, or are in any case conductively connected with the respective pins 16. The sheath 33 of insulating material has pins 38, integrally formed upwardly, which are inserted through bores of the armature 3 and are deformed on the upper side thereof, so that the movable contact arrangement with the contact springs 34 is fixedly connected with the armature 3, and thus moves along with the switching motion thereof. During the mounting of the armature 3 on the base plate 1, first the desired contact spacing between the movable contacts 35 and the fixed contacts 14 is set in a suitable way, before the mounting strips 36 are connected with the bearing supports 16*a* of the terminal pins 16.

A resetting spring 39 is fastened on the armature 3 in the region underneath the bearing leg 156, e.g. by riveted pins of the armature 3 or by means of resistance welding. In the present example, the resetting spring 39 is fashioned in the shape of a T, having a longitudinal leg 39*a* that lies flat on the armature 3 and is connected to it, while the ends 39*b* of a cross-arm lie on corresponding support surfaces 17 of the base body 5.

The base body 5, made of insulating material, has a generally H-shaped cross-section with a separating wall 51 parallel to the basic plane and circumferential side walls 52, which downwardly form, together with the dividing wall 51, the aforementioned switching chamber 4, and upwardly form the coil chamber 6. The dividing wall 51 has two through-holes 53, in which two ferromagnetic yokes 154 and 155 are inserted. The yoke 154 is arranged standing vertically as a flat plate, while the yoke 155 is likewise arranged standing vertically with a leg, but has an additional, L-shaped, bent bearing leg 156, which extends underneath the coil 7, parallel to the axis thereof, and extends roughly to the center of the coil 7, where its end segment 157 is bent slightly downwardly, and thus forms with its terminating edge a bearing edge 158 for the armature 3. The two yokes 154 and 155 are fastened in the base body by means of clamping ribs 56.

Along the two longitudinal sides of the base body 5, shoulders 57 are integrally formed underneath the dividing wall 51, the shoulders 57 lie over the terminal pins 15 and 16 and, if needed, can serve as support areas for correspondingly elongated terminal pins. Grooves 63 are respectively fashioned under these shoulders 57, bounded by the outer wall 52 of the base body and by a wall web 59. This wall web 59 simultaneously forms an insulation between the metal parts of the armature 3 and the terminal elements or bearing strips 36 of the contact springs 34. Sealing (potting) compound 160 can be poured into these grooves 63, in order to anchor terminal pins 15 and 16 which respectively protrude into the grooves 63 in the base body 5 with their upper segments; the rigidity of the housing being additionally increased in this way. This is particularly important for the case in which the terminal pins are fashioned as press-fit stems and are to be pressed into contact bores of a circuit board by means of corresponding pressure on the housing. The construction of the relay is also suited, however, for other types of connections. Thus, the terminal pins can be fashioned on the lower side as normal soldering pins or also as SMT terminals.

The coil 7 has a coil body 71 made of insulating material, on which a winding 73 is arranged between flanges 72. A core 74 is arranged in an axial through-opening of the coil body 71. Coil terminal pins 75 are respectively anchored in the flanges 72.

During assembly, the coil 7 is set into the coil chamber 6 of the base body 5 from above, with the coil terminal pins 75 being inserted through corresponding holes (not visible) of the base body 5. The core 74 thereby comes into contact with the two yokes 154 and 155 at its ends. It would also be possible to produce the core 74 and the bent yoke 155 in one piece; a corresponding opening would then have to be left in the base body 5 for assembly. After the assembly of the coil 7, the coil 7 is fixed in the base body 5 with sealing (potting) compound 160, and the yokes 154 and 155 thus are also glued and the through-holes 53 are thereby also tightly sealed. A very stable bond, which is also capable of receiving high mechanical forces, arises by the filling of the coil chamber 6 with sealing compound. A cover 76 is, for example, disposed above the coil 7, offering a flat surface for inscription. The cover 76 can be a metal or a metal coated plate, so that it forms a heat shield, if the relay is exposed to strong heat radiation, e.g. in SMT mounting.

The base plate 1, pre-assembled with the armature 3, is subsequently set into the switching chamber 4 of the base body 5, with the side walls 52 of the base body 5 overlapping the side walls 12 of the base plate 1 in an interleaved fashion. The base plate 1 is pushed in far enough that the armature 3 lies more or less on the bearing edge 158, and can perform a switching motion about this bearing edge 158. After setting the exact position between the armature 3 and the yokes 154 and 155, the base plate 1 is fixedly connected with the base body 5, preferably by means of pouring in sealing (potting) compound or glue in the edge gap between the respective side walls.

Although modifications and changes may be suggested by those skilled in the art, it is the intention of the inventors to embody within the patent warranted hereon all changes and modifications as reasonably and properly come within the scope of their contribution to the art.

We claim as our invention:

1. An electromagnetic relay comprising:

a base plate of insulating material having a bottom side defining a basic plane;

a plurality of fixed contacts and contact terminal pins mounted in said base plate;

a rocker armature having opposite sides;

means attached to said opposite sides of said rocker armature for rotatably mounting said rocker armature over said base plate with an axis of rotation parallel to said basic plane;

a coil disposed above said armature having a coil axis parallel to said basic plane and perpendicular to said axis of rotation of said rocker armature;

a core disposed axially in said coil, said coil having opposite ends with first and second yokes respectively disposed at said opposite ends, each of said first and second yokes directed downwardly perpendicular to said basic plane;

said first yoke having a bent, L-shaped bearer leg extending parallel to said coil axis and forming a bearing point for said rocker armature beneath a center of said coil, and said second yoke forming a working air gap with said rocker armature comprising the only working air gap of said electromagnetic relay;

a resetting spring mounted for prestressing said rocker armature into a rest position on said first yoke; and a contact spring arrangement fixedly attached to said armature via a sheath of insulating material, said contact spring arrangement making and breaking electrical connections with respective ones of said fixed contacts corresponding to rotational motion of said rocker armature.

2. An electromagnetic relay as claimed in claim 1 wherein said bearer leg of said first yoke has a free end forming a bearing edge bent toward said rocker armature.

3. An electromagnetic relay as claimed in claim 1 wherein said resetting spring comprises a leaf spring fastened to a surface of said rocker armature facing said first yoke and supported on said base plate.

4. An electromagnetic relay as claimed in claim 3 wherein said resetting spring has a T-shape with a longitudinal leg and a cross-leg with opposite ends, said longitudinal leg being fastened on said rocker armature and said ends of said cross-leg being disposed on support surfaces of said base plate.

5. An electromagnetic relay as claimed in claim 1 further comprising a base body of insulating material having a dividing wall with openings therein through which said first and second yokes extend, said dividing wall being disposed parallel to said basic plane between said rocker armature and said coil;

said base body having sidewalls interleaved with said base plate and forming, together with said base plate, a switching chamber which is at least partially closed; and said base plate having shoulders respectively disposed at opposite ends of said rocker armature each shoulder having a plurality of said contact terminal pins disposed in a row beneath said shoulder.

6. An electromagnetic relay as claimed in claim 5 wherein said base body has a substantially H-shaped cross-section, with an upwardly open, tub-shaped coil chamber in which said coil is disposed.

7. An electromagnetic relay as claimed in claim 6 wherein said coil is at least partially embedded in said coil chamber with sealing compound.

8. An electromagnetic relay as claimed in claim 1 wherein said contact spring arrangement comprises two co-planar contact springs, each contact spring having a flexible terminal segment extending laterally toward said bearing point of said rocker armature said terminal segment being connected with one of said terminal pins, and the respective terminal segments of said contact springs serving, in combination, as bearing strips for said rocker armature.

9. An electromagnetic relay as claimed in claim 8 comprising a plurality of prestamped conductor paths embedded in a single plane in said base plate, and respectively forming supports for said fixed contacts, the respective terminal segments of said contact springs, and said terminal pins.

10. An electromagnetic relay as claimed in claim 1 further comprising a plurality of prestamped conductor paths embedded in a single plane in said base and respectively forming supports for said fixed contacts and said terminal pins, said terminal pins projecting perpendicularly from said basic plane and passing through the plane of said conductor paths and being connected to said conductor paths.

11. An electromagnetic relay as claimed in claim 10 further comprising a base body made of insulating material and having a dividing wall with openings therein through which said first and second yokes extend parallel to said basic plane between said armature and said coil, said base body being connected to said base plate with said coil and said armature being enclosed by said base body, said base body having shoulders respectively disposed on opposite sides of said armature with respective portions of said plurality of terminal pins being disposed beneath said shoulders with each terminal pin having an upper end supported on the respective shoulders.

12. An electromagnetic relay as claimed in claim 11 wherein said base body has a downwardly open groove adjacent said shoulders, said respective upper ends of said terminal pins extending into said groove, and further comprising sealing compound in said groove fixing said upper ends of said terminal pins in said groove.

* * * * *